United States Patent [19]

Collis et al.

[11] 3,931,784

[45] Jan. 13, 1976

[54] TILT POSITION INDICATOR

[75] Inventors: Raymond D. Collis, Round Lake; Martin H. Meyer, Libertyville, both of Ill.

[73] Assignee: Outboard Marine Corporation, Waukegan, Ill.

[22] Filed: Aug. 26, 1974

[21] Appl. No.: 500,328

Related U.S. Application Data

[62] Division of Ser. No. 321,049, Jan. 4, 1973, Pat. No. 3,844,247.

[52] U.S. Cl. ..... 115/41 R

[51] Int. Cl.[2] ..... B63H 5/12

[58] Field of Search ..... 115/41 R, 41 HT, 17, 18, 115/34 R, 35; 116/124 A; 338/162, 166; 340/282, 271, 267 R; 214/761; 73/1 E

[56] References Cited

UNITED STATES PATENTS

| | | | |
|---|---|---|---|
| 3,641,965 | 2/1972 | Schmiedel | 115/41 HT |
| 3,673,561 | 6/1972 | Bronstein | 340/282 |
| 3,722,456 | 3/1973 | Lambrecht et al. | 115/41 R |
| 3,797,449 | 3/1974 | Carpenter et al. | 115/41 HT |

*Primary Examiner*—Trygve M. Blix
*Assistant Examiner*—Charles E. Frankfort
*Attorney, Agent, or Firm*—Michael, Best & Friedrich

[57] ABSTRACT

Disclosed herein is a marine propulsion device including a gauge for indicating the vertical position of a propulsion unit relative to a boat hull attachment device and including an indicator movable in response to variation in electrical current, a circuit for supplying the gauge with electrical current, and a circular rack physically connected to one of the propulsion unit and the attachment device co-axially with the axis of vertical swinging of the propulsion unit, and a pinion in mesh with the rack and connected to the other of the propulsion unit and the attachment device and to the wiper of a potentiometer which is electrically connected to the gauge and to the current supplying circuit and which is operative to vary the electrical current supplied to the gauge in response to vertical swinging movement of the propulsion unit.

2 Claims, 4 Drawing Figures

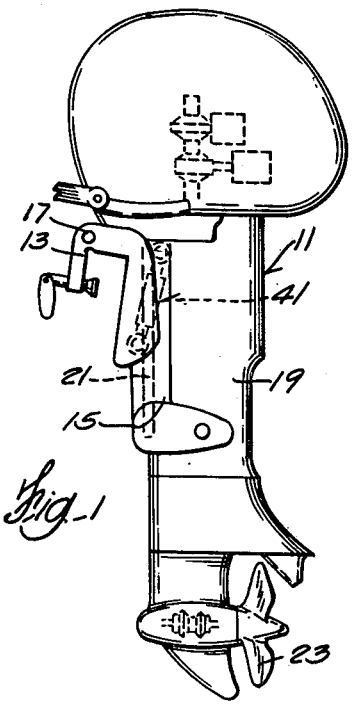
Fig. 1
Fig. 3
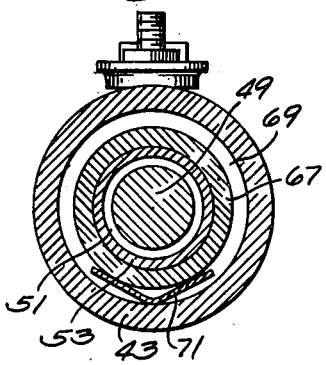
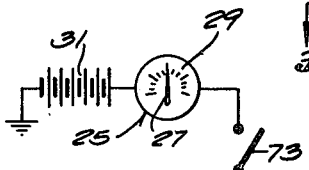
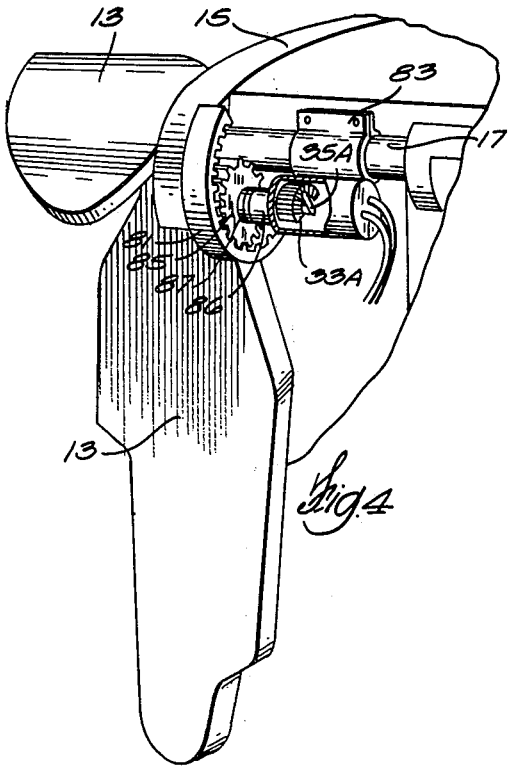
Fig. 4
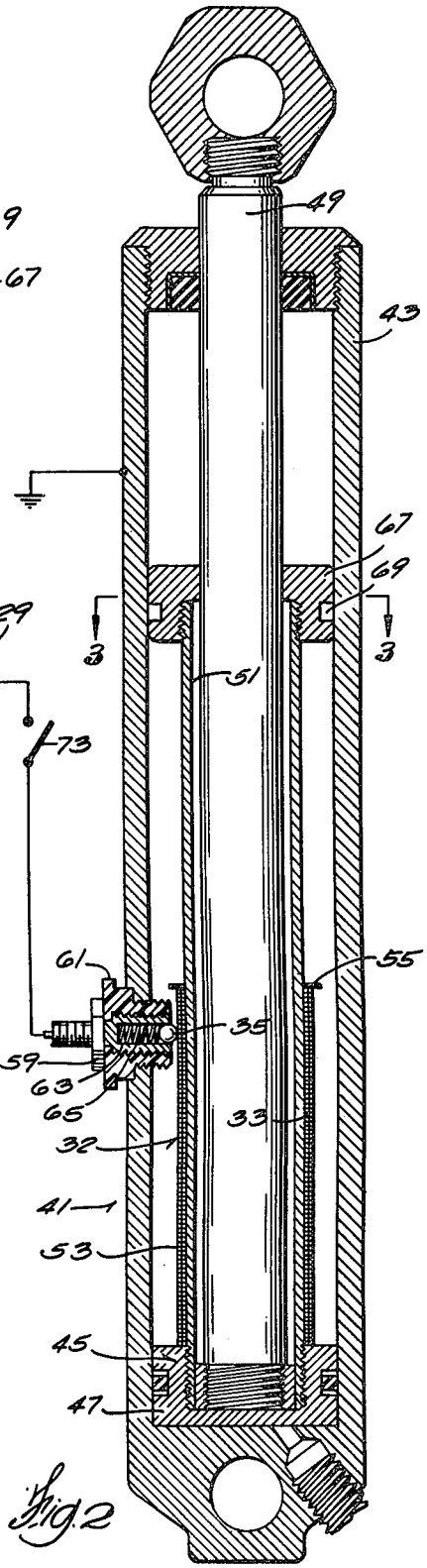
Fig. 2

TILT POSITION INDICATOR

This application is a division of my application Ser. No. 321,049, filed Jan. 4, 1973, now U.S. Pat. No. 3,844,247.

BACKGROUND OF THE INVENTION

Marine propulsion devices, such as outboard motors and stern drive units, have, for many years, included propulsion units which are vertically swingable relative to the supporting boat hull. Various arrangements have been provided for trimming and tilting such propulsion units relative to the boat hull in order to optimize propulsion efficiency and in order to remove the propeller mounted at the lower end of the propulsion unit from the water.

SUMMARY OF THE INVENTION

The invention provides a means for remotely indicating the position of a vertically swingable propulsion unit comprising a gauge including an indicator movable in response to variation in electrical current, and means physically connected between the propulsion unit and a boat hull attachment means and electrically connected to the gauge for varying the electrical current supply to the gauge in response to and in accordance with vertical swinging movement of the propulsion unit.

Such means, in accordance with the disclosed constructions, includes a variable resistance electrically connected to the gauge and to the current source and including a resistance winding or coil mounted on one of the propulsion unit and boat hull attachment means and a wiper mounted on the other of the propulsion unit and boat hull attachment means and movably electrically connected to the resistance coil for varying the current flow to the gauge in response to relative movement between the propulsion unit and the attachment means.

More specifically, the means for varying the electrical current supplied to the gauge also includes a first member physically connected to one of the propulsion unit and the attachment means, together with a second member physically connected to the other of the attachment means and the propulsion unit and connected to the first member for relative movement therebetween in response to and in accordance with vertical swinging movement of the propulsion unit relative to the attachment means. The resistance coil is mounted on one of the members and the wiper is mounted on the other of the members.

In one embodiment in accordance with the invention, the relatively movable members comprise the cylinder of a hydraulic cylinder-piston assembly and the piston movable in the hydraulic cylinder. In another embodiment in accordance with the invention, the members comprise a circular rack stationarily fixed to a swivel bracket and a wiper shaft which is rotatably mounted about a fixed axis to the boat hull attachment means, which wiper shaft supports a pinion in engagement with the circular rack whereby vertical swinging movement of the swivel bracket relative to the boat hull attachment means results in movement of the wiper shaft and consequent variation in the associated resistance coil.

Also, in accordance with the invention, a slip clutch is provided between the pinion and the wiper shaft in order to automatically afford proper alignment between the pinion and the wiper.

One of the principal objects of the invention is the provision of a means for informing the operator at a point remote from the propulsion device of the angular position, or the tilt or trim position, of the propulsion unit relative to the boat hull attachment means.

Another of the principal objects of the invention is the provision of a trim indicating means including an electrically operated meter and a resistance which is varied in accordance with vertical swinging movement of the propulsion unit relative to the boat hull attachment means.

Another of the principal objects of the invention is the provision of a trim and/or tilt indicating means associated with a hydraulic cylinder-piston assembly which is pivotally connected between the boat hull attachment means and the swivel bracket of a marine propulsion device.

Still another of the objects of the invention is the provision of a trim and/or tilt indicating means including a rack and pinion arrangement which is mounted between the swivel bracket and the boat hull attachment means or transom bracket and which is operable to rotate a wiper so as to vary a resistance in accordance with vertical swinging movement of the swivel bracket relative to the boat hull attachment means.

Other objects and advantages of the invention will become known by reference to the following description, claims, and accompanying drawings.

THE DRAWINGS

FIG. 1 is a partially broken away side elevational view of a marine propulsion device incorporating various of the features of the invention.

FIG. 2 is partially sectioned and partially schematic view of various of the components incorporated in the marine propulsion device shown in FIG. 1.

FIG. 3 is a sectional view taken along the line 3—3 of FIG. 2.

FIG. 4 is a perspective view of still another arrangement for generating an electrical output in response to vertical swinging movement of a propulsion unit, which electrical output can be employed in the circuit shown schematically in FIG. 2 to advise the operator of the trim or tilt position of the propulsion unit.

Before explaining the invention in detail, it is to be understood that the invention is not limited in its application to the details of construction and arrangement of parts set forth in the following general description or illustrated in the accompanying drawings, since the invention is capable of other embodiments and of being practiced or carried out in various ways. Also it is to be understood that the phraseology or terminology employed herein is for the purpose of description and not of limitation.

General Description

Shown in the drawings is a marine propulsion device in the form of an outboard motor 11 including attachment means in the form of a transom bracket 13 for connecting the motor 11 to a boat hull, together with a swivel bracket 15 connected to the transom bracket 13 for vertical swinging movement of the swivel bracket 15 relative to the transom bracket 13 about a tilt pin 17, and a propulsion unit 19 pivotally connected to the swivel bracket 15 about a king pin 21 for steering movement of the propulsion unit 19 relative to the swivel bracket 15 about an axis perpendicular to the tilt pin 17 and for vertical swinging movement of the propulsion unit 19 in common with the swivel bracket 15 relative to the attachment means or transom bracket 13. Carried by the propulsion unit 19 is a propeller 23 which, under the normal operating conditions, is submerged in water. As thus far disclosed, the construction is entirely conventional. While the propulsion device is illustrated as an outboard motor, the invention is equally applicable to stern drive units.

In accordance with the invention, there is provided means for remotely indicating the vertical position of the propulsion unit 19 or swivel bracket 15 relative to the attachment means 13 or boat hull. In further accordance with the invention, such means comprises a gauge 25 including an indicator or pointer 27 movable in response to variation in electrical current, a source of electrical current, and means for varying the current applied to the gauge 25 in accordance with and in response to vertical swinging movement of the propulsion unit 19.

Various gauges can be employed. The gauge 25 shown in FIG. 2 is in the form of a commercially available resistance driven meter including a face plate having indicia 29 indicative of the permissible angular range of the propulsion unit, together with the indicator or pointer 27 which is movable relative to the indicia 29 in proportion to the current supplied to the gauge 25.

Various electrical sources can be employed. It is preferred that the electrical current source provide direct current which is substantially of uniform potential. Accordingly, in the illustrated construction as shown in FIG. 2, a direct current battery 31 is electrically connected to the gauge 25.

The means for varying the electrical current supplied to the gauge 25 in response to vertical swinging movement of the propulsion unit 19 can take various forms, and includes a variable resistance 32 which is electrically connected in series with the gauge 25 and the battery 31. The variable resistance 32 includes a resistance coil 33 and a wiper 35 which is movably electrically connected to the resistance coil 33 to vary the effective resistance of the coil 33 in accordance with the position of the propulsion unit 19.

Various coils and wipers can be employed in various arrangements for varying the resistance of the coil in accordance with the position of the propulsion unit 19. In the construction shown in FIG. 2, the variable resistance 32 is associated with a hydraulic cylinder-piston assembly or means 41 which can take various forms and which, in the disclosed construction, corresponds to the trim cylinder-piston assembly disclosed in the United States Borst et al. U.S. Pat. No. 3,885,517, issued May 27, 1975, which patent is incorporated herein by reference.

More specifically, the hydraulic cylinder means 41 comprises a first member or cylinder 43 which is pivotally connected to one of the transom bracket 13 and swivel bracket 15 and a second member in the form of a piston assembly 45 including a piston 47 and an operably connected piston rod 49 which is pivotally connected to the other of the transom bracket 13 and swivel bracket 15. The piston assembly 45 is telescopically received in the cylinder 43 and is movable therein relative to the cylinder 43 in accordance with the vertical swinging movement of the propulsion unit 19. Extending from the piston 47 in the construction shown in FIG. 2 is a sleeve 51 which carries thereon the resistance coil 33 which is in the form of an annular winding wound around an insulating bobbin 53 and which is retained on the sleeve 51 in fixed position relative to the piston 47 by a snap ring 55.

The wiper 35 is mounted on the cylinder 43 and is in the form of a ball contact which is retained in electrical engagement with the coil 33 by a retainer 59 which, in turn, is held in place by a holding member 61 of insulating material. As illustrated, the retainer 59 has an inwardly open bore 63 which receives the ball contact or wiper 35 and which houses a spring 65 biasing the ball contact or wiper 35 into engagement with the coil 33. Accordingly, movement of the piston 47 within the cylinder 43 causes variation in the effective resistance of the coil 33.

As shown in FIG. 2, the coil 33 is grounded at one end and thereby electrically connected to the battery 31 in series with the gauge 25.

More specifically, in the specifically illustrated construction, the end of the coil 33 adjacent to the piston 47 is electrically connected to the sleeve 51 which, at its other end, is fixed to a guide 67 having an annular groove 69. Located in the groove 69, as shown in FIG. 3, is a slider or contact 71 which electrically couples the end of the coil 33 adjacent to the piston 47 to the cylinder 43 and thereby to the outboard motor 11 which also serves as a ground for the battery 31.

Assuming fixed connection of the piston rod 49 to the piston 47, it is evident that the effective resistance would vary in proportion to the amount of extension and contraction of the hydraulic cylinder means 41 through the full range of permissible propulsion unit vertical swinging movement. However, in the disclosed construction and as particularly disclosed in the beforementioned U.S. Pat. No. 3885517, the piston rod 49 is movable relative to the piston 47, and the piston 47 is movable in accordance with propulsion unit movement only through the trim range or lower part of the permissible tilling or swinging movement of the propulsion unit. Thus, in the construction disclosed in FIG. 2, the gauge 25 is limited to portraying or indicating the angular position of the propulsion unit 19 relative to the attachment means 13 or boat hull solely within the trim range.

The hydraulic fluid in the hydraulic cylinder means 41 is retained in the cylinder 43 solely to the right of the piston 47 and the coil 33 and ball contact or wiper 35 are located in a non-hydraulic fluid environment.

Any suitable series electrical connection between the gauge 25, variable resistance 32 and battery 31 can be employed. Also included in the circuit shown in FIG. 2 is a series connected, key operated ignition switch 73 which closes when the associated engine is operated and which opens when the associated engine is not operating.

Shown in FIG. 4 is another arrangement for providing a variable resistance or means which is variable in accordance with the position of the propulsion unit 19. More specifically, in the construction shown in FIG. 4, there is provided a first member which is in the form of a circular rack 81 and which is fixedly attached to the swivel bracket 15 by any suitable means, with the axis of the circular rack 81 coinciding with the axis of vertical swinging movement of the propulsion unit 19. Thus, the rack 81 has common pivotal movement with the swivel bracket 15 and propulsion unit 19.

Fixed to the transom bracket 13 is a stationarily located variable resistance coil 33A housed in a bracket 83 which is suitably fixed to the tilt pin 17 stationarily located relative to the transom bracket 13 or which can be suitably fixed directly to the transom bracket. The resistance coil 33A is electrically connected to a wiper 35A which is supported by the bracket 83 for rotation about the tilt axis and which is connected to a pinion 85 engaged with the rack 81. Thus, vertical swinging movement of the swivel bracket 15 and connected propulsion unit 19 relative to the attachment means or transom bracket 13 causes variation in the resistance of the coil 33A.

The wiper 35A and coil 33A are connected in series with the battery 31 and gauge 25 in the same manner as connection of the coil 33 and wiper 35 in FIG. 2, so that the electrical current applied to the gauge 25 varies in accordance with the resistance of the coil 33A.

In further accordance with the invention, a friction slip clutch is provided between the wiper 35A and the pinion 85, so that upon initial full travel of the propulsion unit 19 to to either its fully raised or fully lowered position, the wiper 35A will be automatically properly angularly located in relation to the pinion 85. In this regard, the wiper 35A has associated therewith one or more stops (not shown) which are located so as to prevent movement of the wiper 35A beyond positions corresponding to fully elevated or fully lowered positions of the propulsion unit 19. Thus, regardless of the initial angular relationship between the pinion 85 and the wiper 35, when the propulsion unit 19 is vertically moved toward one of its fully raised or fully lowered positions, the wiper 35A will engage one of the stops and the pinion 85 will initially slip until the fully raised or fully lowered position is obtained. Thereafter, the movement of the pinion 85 will cause corresponding movement of the wiper 35A in accordance with the position of the propulsion unit 19. If desired, only one such stop can be employed.

Although other arrangements can be employed, in the specifically disclosed construction, the wiper 35A is carried by a shaft 86 and the clutch takes the form of an annular ring 87 which, for practical purposes, is fixed to one of the wiper shaft 86 and the interior bore of the pinion 85 and which has projections therein in frictional engagement with the other of the wiper shaft 86 and the interior bore of the pinion 85. Thus, when the wiper 35A engages a stop prior to full travel of the propulsion unit, relative movement between the wiper shaft 86 and the pinion 85 is permitted. However, thereafter, the pinion 85 and wiper shaft 86 and connected wiper 35A move in unison.

In the construction shown in FIG. 4, the indicator is operable over the full range of permissible propulsion unit vertical tilting movement.

Various of the features of the invention are set forth in the following claims.

We claim:

1. A marine propulsion device comprising means for attachment to the hull of a boat, a propulsion unit pivotally connected to said attachment means about a tilt axis for vertical swinging movement of said propulsion unit relative to said attachment means, and means for indicating the position of said propulsion unit relative to said attachment means comprising a gauge including an indicator movable in response to variation in electrical current, and means physically connected between said propulsion unit and said attachment means and electrically connected to said gauge for varying the electrical current supplied to said gauge in response to vertical swinging movement of said propulsion unit, said means for varying said electrical current comprising a circular rack physically connected to one of said propulsion unit and said attachment means and including a plurality of teeth extending in an arcuate series at a uniform distance from said tilt axis with said teeth individually extending parallel to said tilt axis, a rotatably mounted pinion physically connected to the other of said attachment means and said propulsion unit and enmeshed with said rack for rotation of said pinion in response to vertical swinging movement of said propulsion unit relative to said attachment means, and a variable resistance electrically connected in series to said gauge and including a resistance coil mounted on one of said propulsion unit and said attachment means and a wiper movably electrically connected to said coil for varying the current flow to said gauge in response to relative movement between said wiper and said coil, said wiper also being connected to said pinion for rotation of said wiper in response to rotation of said pinion incident to vertical swinging movement of said propulsion unit.

2. A marine propulsion device in accordance with claim 1 and further including frictional slip-clutch means between said pinion and said wiper.

* * * * *